US008893808B1

(12) United States Patent
Valerio

(10) Patent No.: US 8,893,808 B1
(45) Date of Patent: Nov. 25, 2014

(54) CONTROL SYSTEMS AND METHODS FOR CENTERING A TOOL IN A WELLBORE

(71) Applicant: Cary A. Valerio, Salt Lake City, UT (US)

(72) Inventor: Cary A. Valerio, Salt Lake City, UT (US)

( * ) Notice: Subject to any disclaimer, the term of this patent is extended or adjusted under 35 U.S.C. 154(b) by 0 days.

(21) Appl. No.: 14/249,209

(22) Filed: Apr. 9, 2014

Related U.S. Application Data

(62) Division of application No. 14/249,092, filed on Apr. 9, 2014.

(51) Int. Cl.

| | |
|---|---|
| ***E21B 47/01*** | (2012.01) |
| ***E21B 23/14*** | (2006.01) |
| ***E21B 23/01*** | (2006.01) |
| ***E21B 23/00*** | (2006.01) |

(52) U.S. Cl.
CPC ..... *E21B 23/00* (2013.01); *E21B 23/01* (2013.01)
USPC ..... 166/385; 166/66; 166/242.2; 166/254.2

(58) Field of Classification Search
CPC ..... E21B 23/00; E21B 23/01; E21B 23/14; E21B 47/01; G01V 1/52
USPC ..... 166/385, 242.2, 250.01, 66
See application file for complete search history.

(56) References Cited

U.S. PATENT DOCUMENTS

| | | | | |
|---|---|---|---|---|
| 2,899,633 | A | | 8/1959 | Smith et al. |
| 3,087,552 | A | | 4/1963 | Graham |
| 3,762,473 | A | | 10/1973 | Wolk |
| 3,915,229 | A | | 10/1975 | Nicolas |
| 4,549,630 | A | | 10/1985 | Brown |
| 4,557,327 | A | | 12/1985 | Kinley et al. |
| RE32,070 | E | | 1/1986 | Vezin |
| 4,615,386 | A | | 10/1986 | Briscoe |
| 4,693,328 | A | | 9/1987 | Furse et al. |
| 4,790,381 | A | | 12/1988 | Armell |
| 4,811,792 | A | | 3/1989 | Lembcke et al. |
| 4,830,105 | A | | 5/1989 | Petermann |
| 5,005,642 | A | | 4/1991 | Moore |
| 5,111,880 | A | * | 5/1992 | Wittrisch et al. ..... 166/385 |
| 5,348,091 | A | | 9/1994 | Tchakarov et al. |
| 5,353,872 | A | * | 10/1994 | Wittrisch ..... 166/250.01 |

(Continued)

OTHER PUBLICATIONS

NEA Electronics, Inc., Non-Explosive Separation Nut/Release Mechanism, Product Technical Data Sheet, 2 pages.

(Continued)

*Primary Examiner* — Kenneth L Thompson
(74) *Attorney, Agent, or Firm* — Brinks Gilson & Lione; Craig Buschmann

(57) ABSTRACT

A self-centering tool for use in a wellbore includes a centering mechanism, a biasing mechanism, and a release mechanism. The centering mechanism includes at least one arm that is configured to move from a first position to a second position. The arm urges a centerline of the tool towards a centerline of the wellbore when in its second position. A biasing mechanism is coupled to the centering mechanism and urges the arm from its first position to its second position. The release mechanism is electro-mechanically actuated. In its locked position, the release mechanism prevents the arm from moving towards its second position, while in its released position the arm is able to move towards its second position. The release mechanism is a split-spool type mechanism. A control system that includes one or more sensors controls the operation of the release mechanism.

25 Claims, 6 Drawing Sheets

(56) References Cited

U.S. PATENT DOCUMENTS

| | | | | |
|---|---|---|---|---|
| 5,355,950 | A | 10/1994 | Zwart | |
| 5,520,245 | A * | 5/1996 | Estes | 166/66 |
| 5,531,112 | A * | 7/1996 | Young et al. | 73/152.02 |
| 5,934,378 | A | 8/1999 | Tchararov | |
| 5,947,213 | A * | 9/1999 | Angle et al. | 175/24 |
| 6,181,642 | B1 * | 1/2001 | Coates et al. | 367/25 |
| 6,920,936 | B2 | 7/2005 | Sheiretov et al. | |
| 7,000,696 | B2 * | 2/2006 | Harkins | 166/250.01 |
| 7,090,007 | B2 | 8/2006 | Stuart-Bruges et al. | |
| 7,281,578 | B2 * | 10/2007 | Nakajima et al. | 166/255.2 |
| 7,392,859 | B2 * | 7/2008 | Mock et al. | 175/99 |
| 7,607,478 | B2 * | 10/2009 | Martinez et al. | 166/250.01 |
| 7,954,567 | B2 | 6/2011 | Haughom | |
| 8,109,331 | B2 * | 2/2012 | Lynde et al. | 166/105.3 |
| 8,443,915 | B2 | 5/2013 | Storm, Jr. et al. | |
| 8,579,037 | B2 * | 11/2013 | Jacob | 166/382 |
| 2011/0005776 | A1 | 1/2011 | Reid | |
| 2011/0198099 | A1 | 8/2011 | Zierolf | |
| 2012/0239345 | A1 | 9/2012 | Fraser et al. | |
| 2013/0341007 | A1 | 12/2013 | Umphries et al. | |

OTHER PUBLICATIONS

Cooper Interconnect, Non-Explosive Actuators, Heritage-proven technologies support rapid releases, field-resettable testing, and save handling and deployment, 28 pages.

* cited by examiner

CONTROL SYSTEMS AND METHODS FOR CENTERING A TOOL IN A WELLBORE

RELATED APPLICATION

The present patent document is a divisional application and claims the benefit of priority to U.S. Non-Provisional patent application Ser. No. 14/249,092, filed Apr. 9, 2014, and entitled "SELF-CENTERING DOWNHOLE TOOL," the entire contents of which are incorporated herein by reference.

BACKGROUND

The present invention relates to tools for use in a wellbore, particular those wellbores drilled for water, oil, gas, other natural resources, disposal wells, and conduits for utilities. In particular, the tools disclosed provide structures that detect when a tool becomes stuck or lost (i.e., decoupled from the surface) in the wellbore and that reposition the tool within the wellbore to improve the likelihood that the tool will be recovered.

There are many types of tools that are used in wellbore, both during construction of the wellbore and after the wellbore is completed. Regardless of the type of tool, there always exists a risk that the tool will become stuck in the wellbore or lost/decoupled from the surface, regardless of whether or not the wellbore is cased or open hole. When a tool is stuck or lost downhole, subsequent operations with the wellbore are impaired, costing both time and money to remedy. Thus, it is desirable to retrieve the tool as expeditiously as possible.

Previously, tools included a fishing or latching head that allowed a fishing tool or overshot to settle and latch upon the fishing head. Once latched, the overshot and coupled tool could be retrieved with a wireline or other similar method by which it was originally conveyed into the wellbore.

New wellbore drilling and construction techniques, however, make the use of an overshot to retrieve a tool more challenging. For example, many wells now are directionally drilled and may have a very high degree of inclination. In such cases, the tool may rest on the bottom, or low side, of the wellbore as a consequence of the gravitational force acting on the tool. Since the exact disposition of the tool likely is unknown, it is often very difficult to get an overshot to land upon and latch onto a fishing head.

Previous efforts to solve this problem employed various centralizers and mechanisms. Often, however, these efforts relied upon crude measures of controlling and actuating the centralizers. For example, U.S. Pat. No. 3,087,552 discloses the use of acid soluble materials that degrade in the presence of an acid to trigger the centralizers. Such systems cause definitive deployment of the centralizers after a given period of time, but the exact time was not predictable as it is a function of the concentration of the acid, the variable properties of the materials to be dissolved, and the like. In addition, the acid had to remain in position as a "pill" or "slug" around the tool for the necessary amount of time. To do so requires that no fluid be flowing, whether around the tool when in drill pipe or casing or produced fluid during production operations. Stopping the flow of fluid around the tool potentially increases cost (particularly if a well must be shut in/killed) and risks to wellbore stability and getting the tool stuck. Further, such systems were insensitive to whether or not the centralizers actually needed to be deployed. Deployed centralizers could cause many problems, including increasing the risk of getting the tool stuck, so it is not something to be done lightly.

Thus, there is a need for a tool that reliable actuates a centralizer mechanism that would position the tool more advantageously within the wellbore in order to improve the likelihood it will be retrieved.

There further is a need for a tool that includes centralizers that can be actuated under defined conditions, regardless of whether the instruction to actuate the tool comes from the surface or is determined by the tool when certain parameters are met.

BRIEF SUMMARY

A tool for use in a wellbore includes a housing with a housing centerline, an outer surface, and an inner surface spaced apart from the outer surface. The housing includes at least one opening that extends from the inner surface to the outer surface. The tool includes a centering mechanism that comprising at least one arm configured to be received at least partly within the opening. The arm includes a first position and a second position. A biasing mechanism is coupled to the centering mechanism and is configured to apply a first force that urges the centering mechanism and, more particularly, the arms its first position towards its second position. A release mechanism is coupled to the centering mechanism. The release mechanism is electro-mechanically actuated from (a) a locked position in which the release mechanism is configured to apply a second force that opposes the first force to maintain the arm in at least the first position to (b) a released position in which the release mechanism does not apply the second force, thereby allowing the biasing mechanism to urge the arm towards the first position.

In another embodiment of a tool for use in a wellbore, the tool includes a housing with a housing centerline, an outer surface, and an inner surface spaced apart from the outer surface. A centering mechanism includes an upper traveling head having a first position and a second position, and at least one arm having a first end and a second end spaced apart from said first end. The first end of the arm is pivotally connected to the upper traveling head such that when the upper traveling head is in the first position the first end and the second end are proximate the housing centerline. When the upper traveling head is in the second position the first end of the arm is proximate the housing centerline and the second end is positioned radially away from the housing centerline. A biasing mechanism includes a first end coupled to the upper traveling head and a second end spaced apart from the first end. The second end of the biasing mechanism is fixed relative to the inner surface of the housing. A biasing element is coupled to the first end and the second end of the biasing mechanism. A release mechanism is coupled to the upper traveling head of the centering mechanism. The release mechanism is electro-mechanically actuated from a locked position in which the release mechanism maintains the upper traveling head in its first position to a released position in which the release mechanism releases the upper traveling head, thereby allowing the biasing element to urge the upper traveling head towards its second position.

In another embodiment of a tool for use in a wellbore, the tool includes a centering mechanism with an upper traveling head and at least one arm having a first end and a second end spaced apart from said first end. The first end of the arm is pivotally connected to the upper traveling head. A biasing mechanism includes a first end coupled to the upper traveling head and a second end spaced apart from the first end. The second end of the biasing mechanism is fixed relative to the inner surface of the housing. A biasing element is coupled to the first end and the second end of the biasing mechanism. A union includes a first rod coupled to the upper traveling head and a second rod. An electro-mechanical release mechanism grasps the second rod when the electro-mechanical release mechanism is in a locked position and releases the second rod when said electro-mechanical release mechanism is in a released position.

Optionally, embodiments of the release mechanism include a split-spool.

Embodiments of the biasing element include those that exhibit a linear force/distance relationship. Other embodiments of the biasing element include at least one of a spring and a linear actuator.

Embodiments of a control system for the tool are also disclosed. In addition to the various embodiments of the tool discussed, the control system includes a first sensor positioned on the tool that detects a first parameter and generates a first signal reflective of the first parameter. Optionally, the control system includes at least a second sensor that detects at least a second parameter and generates a second signal reflective of the second parameter. A memory storage device stores an operating program configured to calculate an actuation signal as a function of at least one of the first signal and the second signal. A controller is configured to receive at least one of the first signal from the first sensor and the second signal from the second sensor, run the operating program, and transmit the actuation signal to the release mechanism to transition the release mechanism from a locked position to a released position. At least one power source provides power to at least one of the first sensor, the second sensor, the memory storage device, and the controller.

Another embodiment of a control system is configured to calculate an actuation signal for use in actuating a component of a tool positioned in a wellbore. A first sensor detects a first parameter and generates a first signal reflective of the first parameter. At least a second sensor detects at least a second parameter and generates a second signal reflective of the second parameter. A memory storage device stores an operating program, which calculates the actuation signal as a function of at least one of the first signal and the second signal. A controller is configured to receive at least one of the first signal from the first sensor and the second signal from the second sensor, to run the operating program, and to transmit the actuation signal to the component. Optionally, the component that the control system actuates with the actuation signal is a release mechanism.

Also disclosed are embodiments of an operating program to calculate an actuation signal as a function of at least one of a first signal reflective of a first parameter as detected and generated by a first sensor and a second signal reflective of a second parameter as detected and generated by a second sensor. The actuation signal is used to actuate a component of a tool positioned in a wellbore. The operating program includes, in part, a memory storage device to store the operating program and to store at least one of the first signal and the second signal at a first time and at a subsequent time. A controller is configured to receive at least one of the first signal from the first sensor and the second signal from the second sensor, to run the operating program, and to transmit the actuation signal to the component of the tool. In some embodiments, the operating program calculates the actuation signal as a function of a difference in at least one of the first signal and the second signal at the first time and at the subsequent time. In some embodiments, the actuation signal actuates a component that is a release mechanism.

In addition, methods of calculating an actuation signal are disclosed. One embodiment of such a method is for calculating an actuation signal for use in actuating a component of a tool positioned in a wellbore. Optionally, the tool includes a first sensor and at least a second sensor, and a memory storage device that stores an operating program that calculates the actuation signal. A controller is configured to receive at least one of a first signal generated by the first sensor and a second signal generated by the second sensor, to run the operating program, and to transmit the actuation signal to the component. The method itself comprises detecting at least one of a first parameter with the first sensor and a second parameter with the at least second sensor. The method further includes generating at least one of the first signal representative of the first parameter with the first sensor and the second signal representative of the second parameter with the at least second sensor. At least one of the first signal and the second signal at a first time and at a subsequent time are stored on the memory storage device. An actuation signal is calculated as a function of a difference in at least one of the first signal and the second signal at the first time and at the subsequent time. The method also includes transmitting the actuation signal to the component. In some embodiments, the component to be actuated by the actuation signal is a release mechanism.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

DETAILED DESCRIPTION

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
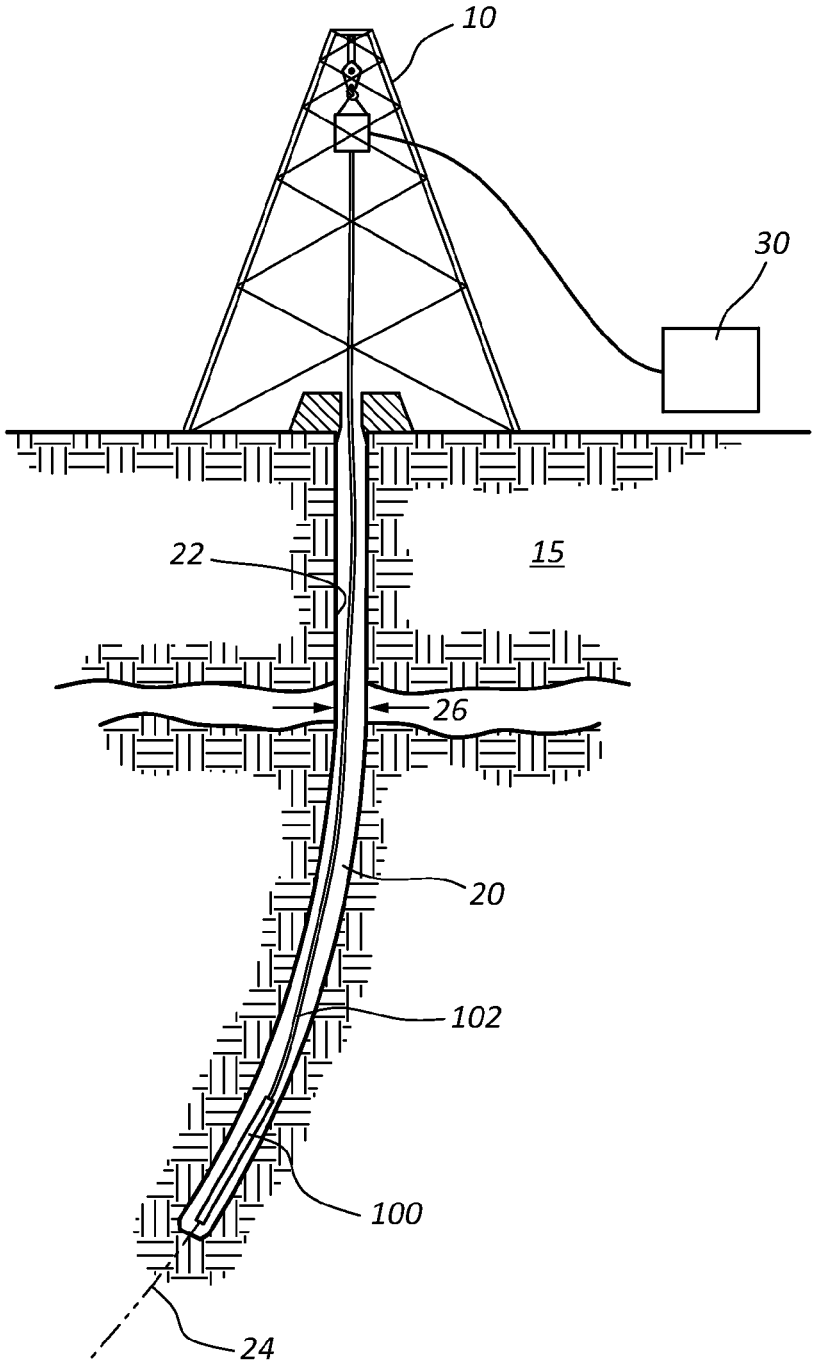
FIG. 1 is an embodiment of tool positioned in a wellbore.

Illustrated in FIG. 1 is a derrick 10, under which a wellbore 20 has been drilled through a formation 15. The wellbore 20 includes a wellbore wall 22, a wellbore centerline 24 and a wellbore diameter 26. The wellbore diameter 26 is centered upon and extends radially from the wellbore centerline 24, and typically will be the nominal diameter of the drill bit that formed the wellbore. The wellbore 20 can be an open hole, i.e., only a formation 15 defines the wellbore wall 22, or a cased hole, i.e., one in which steel tubing or pipe defines the wellbore wall 22. In other words, the tool 100 may be positioned within the wellbore 20 while it is being drilled in some embodiments, after the wellbore 20 is drilled but before it is cased, or after the wellbore 20 is cased (if it is cased at all).

In some embodiments, the wellbore can refer to flowlines, pipelines, and other conduits as known in the art. Thus, while reference in the application is made to a wellbore, the same features apply to flowlines, pipelines, and other conduits. Thus, one of skill in the art would understand that that a wellbore, wellbore centerline, and wellbore diameter refers equally to, for example, the bore of a flowline, the flowline centerline, and the flowline diameter. The same is understood for other pipelines and conduits.

As illustrated, the wellbore 20 is a deviated wellbore, one that has been directionally drilled in a desired direction away from directly below the derrick 10. Of course, embodiments of the invention are suitable for use in wellbores of many types, including vertical, horizontal, extended reach, and wellbores drilled to produce water, natural resources, and/or simply create a conduit through which utilities may be run, for example.

A tool 100 is positioned in the wellbore 20. The tool 100 typically is a wireline conveyed tool, including those conveyed with the aid of drill pipe, downhole tractors, and other mechanism, including coiled tubing and slickline. In some embodiments, the tool 100 is configured as part of a drill collar, such as those typically used for measurement-while-drilling and logging-while-drilling applications. That said, for convenience the following discussion of the tool 100 is presented within the context of a wireline tool. One of skill in the art will understand how each of the disclosed elements is configured within a drill collar and other equivalent structures.

The tool 100 includes a communication link 102 that extends to a surface system 30. As illustrated in FIG. 1, the communication link 102 is a wireline able to transmit data to and/or receive data from the surface system 30. While the communication link 102 is illustrated as a physical wireline, other communication links fall within the scope of the disclosure, including mud-pulse telemetry, wired drill pipe, electro-magnetic telemetry, acoustic telemetry, and other types of telemetry.

The surface system 30 typically includes a computer and data recording system found on a wireline truck, wireline logging unit, measurement- and logging-while-drilling logging unit, and the like. The surface system 30 optionally includes transmitters (e.g., telephony, radio and other forms of electromagnetic transmission, satellite links, Ethernet, etc.) capable of extending the communication link 102 to a remotely located surface system.

Figure 2:
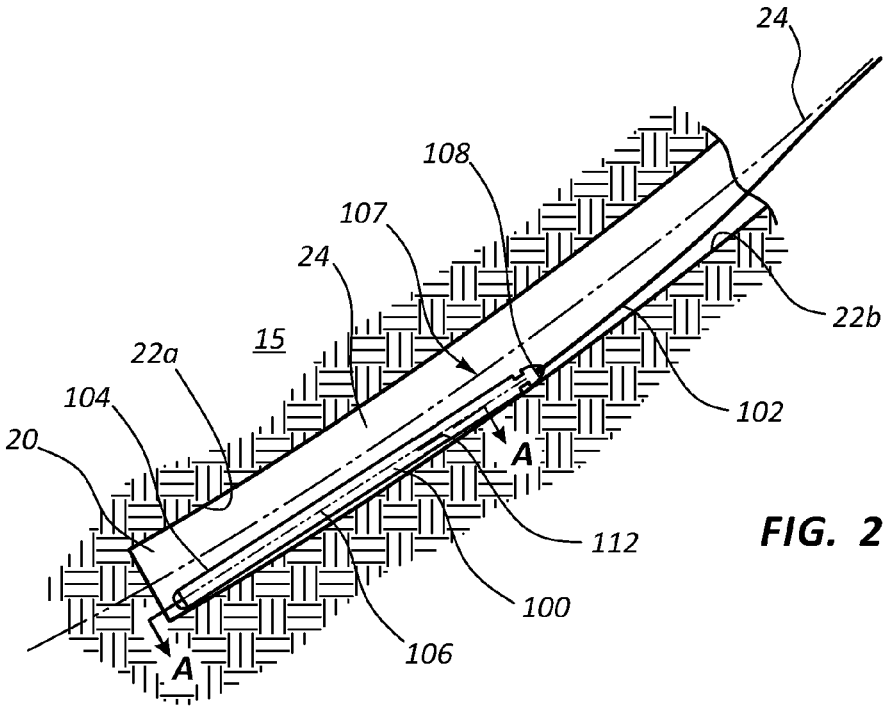
FIG. 2 is the embodiment of the tool in FIG. 1 in which a centering mechanism is not deployed.
Figure 3:
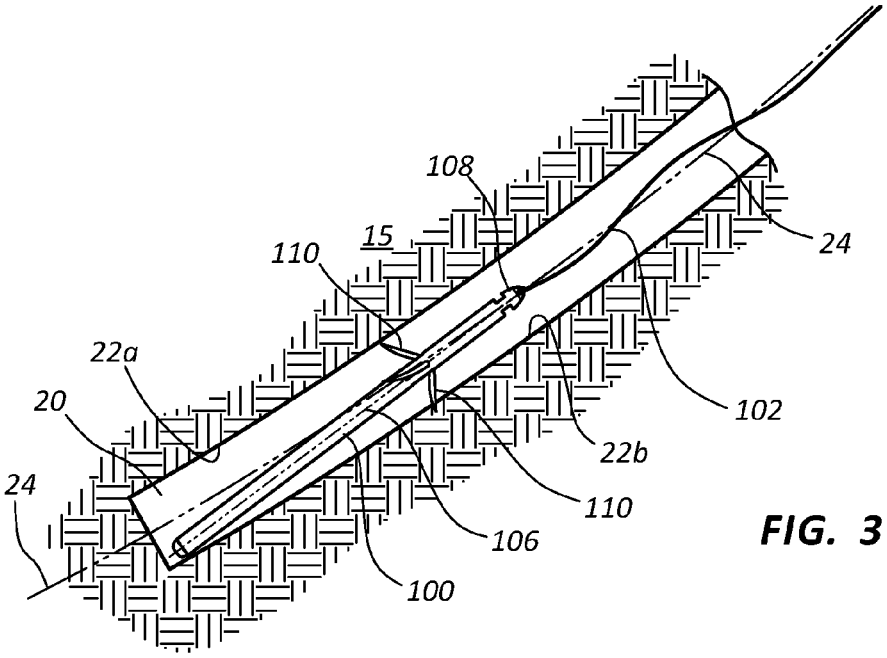
FIG. 3 is the embodiment of the tool in FIG. 1 in which a centering mechanism is deployed.

In FIGS. 2 and 3, the tool 100 is positioned within the wellbore 20 from FIG. 1. As noted, the wellbore 20 in this instance is deviated, thus for reference the wellbore wall 22 includes a high side 22*a* and low side 22*b*, with reference to high and low being relative to vertical, or, more specifically, the vertical component of the gravitational vector. At sufficiently high angles of inclination, the tool 100 will rest upon the low side 22*b* of the wellbore wall 22. Consequently, the centerline 104 of the housing 106 of the tool 100 is spaced apart from the centerline 24 of the wellbore 20.

As previously discussed, there are methods of conveying the tool 100 further downhole (i.e., deeper in measured depth), such as pumping the tool 100 down with drilling or another fluid, using drill pipe or downhole tractors to convey the tool 100, and the like.

A challenge, however, occurs when the tool 100 becomes decoupled from the particular form of conveyance, whether by happenstance or by purposeful action. In that instance, the tool 100 is resting upon the low side 22*b* of the wellbore 20. This particular position causes the optional fishing head or latching head 108 proximate a first end 107 of the tool 100 to also lie upon the low side 22*b*. (One of skill in the art will appreciate that below the fishing head 108 optionally exist jars and/or other tools that are part of the entire string of tools. These optional components are not illustrated for the sake of clarity).

It is more difficult for an overshot or latching mechanism (not illustrated) that is sent downhole to latch onto the fishing head 108 when the tool 100 and the fishing head 108 rest upon the low side 22*b*. In addition, with the tool 100 on the low side 22*b*, there is often an increased risk that the tool 100 will become decoupled as the tool 100 is pulled from, for example, an open hole portion of the wellbore 20 to a cased hole portion, as the fishing head 108 hangs up on the casing. The location of the fishing head 108 against the lip of the casing further may increase the difficulty of latching onto the fishing head 108 with an overshot.

In the event the tool 100 becomes decoupled, at least one arm 110 will extend away from the housing centerline 106, typically extending through an opening 112 in the housing 104 as illustrated in FIG. 3. In so doing, the arm 110 raises the tool 100 and, more particularly, the housing centerline 106 of the tool 100 towards the wellbore centerline 24. This action presents the fishing head 108 in a more advantageous position relative to any overshot or latching mechanism sent downhole to latch onto the fishing head 108, which improves the probability that the overshot will successfully latch onto the fishing head 108.

Figure 4:
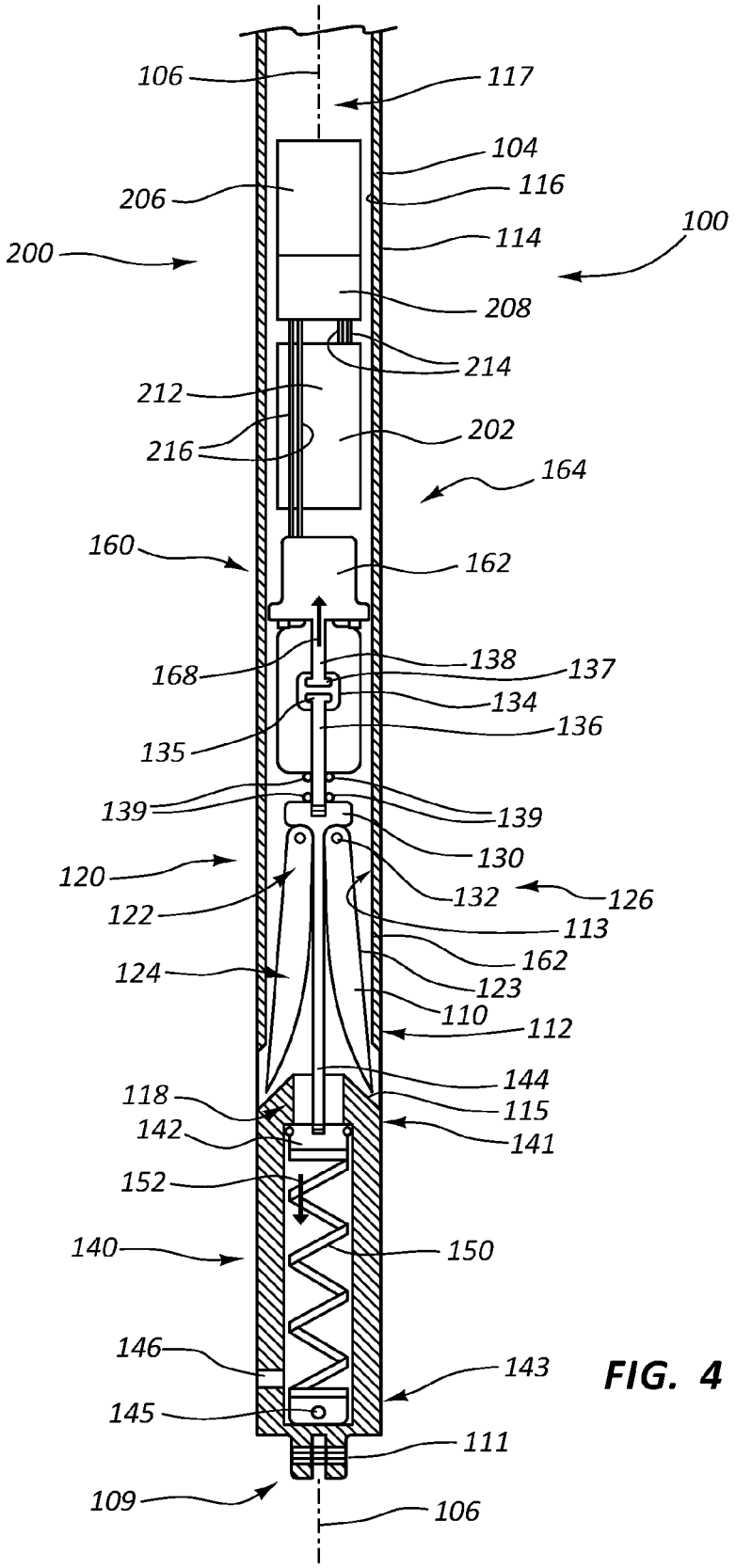
FIG. 4 is a partial cross-section A-A of the tool in FIG. 2 in which the centering mechanism is not deployed.

Turning to FIG. 4, a cross-section of a portion of the tool 100 is illustrated. As noted, the tool 100 includes a housing 104, as is typically in wireline tools, although in other embodiments—such as a measurement-while-drilling or logging-while-drilling tool—the housing may be a drill collar. The tool 100 optionally includes a connection 111 at a second end 109 of the tool 100 that is spaced apart from the first end 107 of the tool 100. The connection 111 may be a threaded connection configured to couple the tool 100 to one or more additional tools below the tool 100. The connection 111 also may include electrical contacts and/or connectors that permit the transmission and/or reception of power and/or data to and from the tool 100, the communication link 102, and to other tools located below the tool 100. If no other tools are located below the tool 100, a suitable end cap may be positioned over or coupled to the connection 111.

The housing 104 also includes a housing centerline 106, an outer surface 114 and an inner surface 116, which is spaced apart from the outer surface 114.

The inner surface 116 defines, at least in part, and interior space 117 in which various components may be positioned, either directly or within special pressure sealed chambers that optionally are separated from each other. In some embodiments, such as a measurement- or logging-while-drilling tool, the interior space 117 optionally includes a flow path (not illustrated) as known in the art to permit and isolate the flow of various drilling fluids and the like from other components that may be positioned in the interior space 117. Optionally, the tool 100 includes at least one of a centering mechanism 120, a biasing mechanism 140, and a release mechanism 160, any one of which or all may be positioned within the interior space 117, regardless of whether or not the interior space is formed of one or more separate chambers, of the tool 100.

Optionally, within the housing 104 is at least one and, in some embodiments, a plurality of openings 112 that extend from the inner surface 116 to the outer surface 114. The shape of the openings 112 typically, although not necessarily, the size and shape of the arms 110. As just one example, the openings 112 may be a slot in those instances in which the arms 110 have a thinner, blade-like profile.

The tool 100 includes a centering mechanism 120. The centering mechanism optionally includes an upper traveling head 130 and at least one arm 110. Two arms 110 are illustrated in the cross-section of FIG. 4, although any number of arms may be used. The upper traveling head 130 and/or the arms 110 and, more generally, the centering mechanism 120, include a first position 126 and a second position 128 (FIG. 5), the purpose of which will be discussed in greater detail below.

The arms 110 typically are configured to be received at least partly within the opening 112. That is, the arm 110 will be either fully or at least partly drawn into the housing 104 in some configurations of the tool 100. In other embodiments, however, the arms 110 may simply couple to the outer surface 114 of the housing 104 and not withdraw into the housing 104.

In the illustrated embodiment, the arms 110 have a thinner, blade-like profile, although other shapes and sizes of arms fall within the scope of the disclosure. For example, the arms 110 may be rod or cylinder shaped, wedge-shaped, rhomboid-shaped, and other similar shapes.

Figure 5:
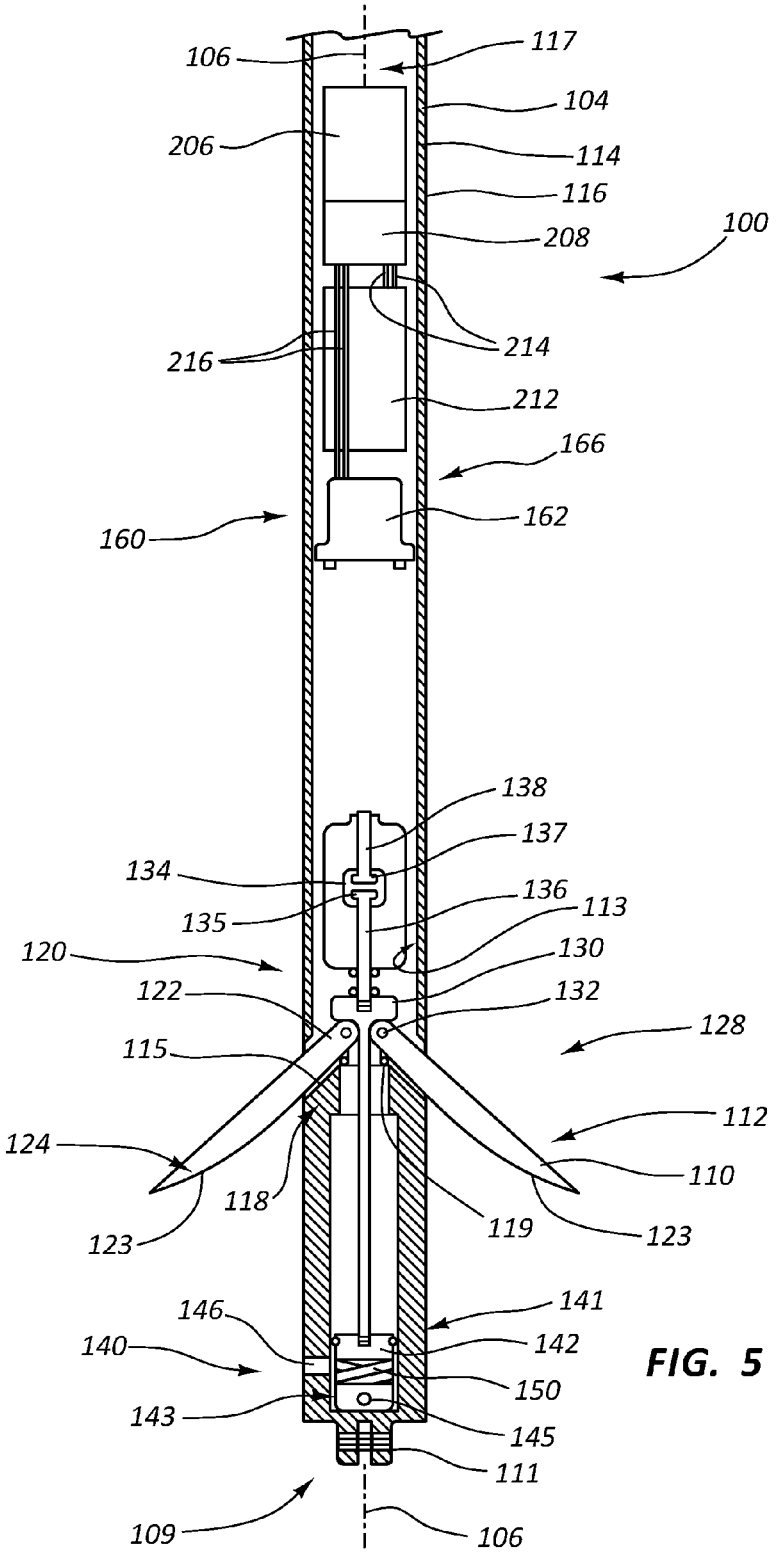
FIG. 5 is a partial cross-section A-A of the tool in FIG. 2 in which the centering mechanism is deployed.

The arms 110 include a first end 122 and a second end 124 that is spaced apart from the first end 122. The arms 110, too, include a first position 126 and a second position 128 (FIG. 5).

The arms 110 optionally are pivotally connected or coupled to the upper traveling head 130 at a pivoting connection 132. In those embodiments in which the arms 110 have a pivoting connection 132, when the upper traveling head 130 and/or the arms 110 are in a first position 126, both the first end 122 and the second end 124 of the arms 110 are proximate the housing centerline 106. In other words, in the first position 126, the first end 122 and the second 124 of the arms 110 are at least partly withdrawn into the housing 104 of the tool 100. Of course, other embodiments of the arms 110 extend radially directly from the tool 100 rather than pivotally, such as through the use of extending cylinders, multi-linked mechanisms, wedges and the like.

When the upper traveling head 130 and/or the arms 110 are in the second position 128 (FIG. 5), the first end 122 of the arms 110 remains proximate or near the housing centerline 106 (e.g., remain at least partly within the housing 104). The second end 124 of the arms 110, however, extends or are positioned radially away from the housing centerline 106 as compared to the first end 122. If the tool 100 were positioned in the wellbore 20, the second end 124 of the arms 110 would extend towards and presses against the wellbore wall 22 when the upper traveling head and/or the arms 110 were in the second position 130. In pressing against the wellbore wall 22, the arms 110 urge the housing centerline 106 towards the wellbore centerline 24. (Of course, one of skill in the art will appreciate that what is called the first position 126 in which the arms 110 are retracted could instead be referred to as the second position. Likewise, what is called the second position 128 in which the arms 110 are extended could instead be referred to as the first position. Thus, it does not matter whether the default or fail-safe position of the tool is one in which the arms are extended or retracted).

In some embodiments, a portion 113 of the inner surface 114 acts to at least partly retain the arms 110 from extending during normal operations when the upper traveling head 130 and/or the arms 110 are in the first position 126.

Optionally, the outer surface 114 includes an angled or sloped surface 115. The angled surface 115 contacts a lower surface 123 of the arms 110 when the upper traveling head 130 and/or the arms 110 are urged or transitioned from the first position 126 to the second position 128. In so doing, the angled surface 115 applies a force to the lower 123 that urges the arms 110 to extend radially away from the housing centerline 106.

The centering mechanism 120 optionally includes a union 134 that couples the centering mechanism 120 and, more specifically, the upper traveling head 130, to the release mechanism 160. In some embodiments, the union 134 couples or joins a first rod 136 that is coupled to the upper traveling head 130 to a second rod 138 that is coupled to the release mechanism 160 as will be explained in further detail below. The first rod 136 and the second rod 138 may be threaded rods on one or both ends of the rod and/or include a flange 135 and 137, respectively. Optional O-rings 139 are positioned around one or both of the rods 136 and 138.

The tool 100 also includes a biasing mechanism 140 in some embodiments. A first end 141 of the biasing mechanism 140 is coupled to the centering mechanism 120. More specifically, the first end 141 of the biasing mechanism 140 and, more specifically, a lower traveling head, 142 is coupled to the upper traveling head 130 of the centering mechanism 120 through a rod 144.

Optionally, in some embodiments the inner surface 116 includes a shoulder 118 or other portion upon which the lower traveling head 142 stops and is prevented from traveling further upward. O-rings 119 optionally are included to provide a seat, an optional seal, and to lessen the force with which the lower traveling head 142 contacts the shoulder 118.

The biasing mechanism 140 also includes a second end 143 that is spaced apart from the first end 141. The second end 143 is fixed relative to the inner surface 116 of the tool 100. For example, a locking pin 145 may fixedly couple the second end 143 relative to the inner surface 116.

The biasing mechanism 140 also includes a biasing element 150 coupled to the first end 141, specifically the lower traveling head 142, and the second end 143 of the biasing mechanism. The biasing element 150 is configured to apply a first force 152 that urges the centering mechanism 120 and, more specifically, the upper traveling head 130 and/or the arms 110 from their respective first position 126 to their second position 128. In other embodiments in which the default position of the tool 100 is reversed, the biasing element urges the first centering mechanism from the second position 128 to the first position 126.

In some embodiments, the biasing element 150 exhibits or comprises a linear force-distance relationship, such as on that follows Hooke's Law. In other embodiments, the biasing element 150 is at least one of a spring and a linear actuator. The linear actuator may include various types of hydraulic or pneumatic cylinders, which may optionally include a port on one or both sides of the cylinder head that would allow a technician to add or remove fluid from the cylinder at the surface. Other examples of linear actuators include linear drives, such as drive screws, and other known types. In addition, various combinations of springs and linear actuators may be employed. For example, a combination biasing element 150 includes a spring and a hydraulic or pneumatic cylinder.

Optionally, the biasing mechanism 140 includes one or more ports 146 that permit an engineer to supply a fluid, such as hydraulic fluid, oil, water, air, or other fluid (whether liquid or gaseous), to the biasing mechanism 140. As shown, the port 146 is positioned between the lower traveling head 142 and the second end 143. In this configuration, the fluid could be added to urge the lower traveling head 142 upward and thereby to extend the biasing element 150. Such a feature could be useful when placing the arms 110 in the first position 126 at the surface, particularly in those embodiments that include a biasing element capable of supplying a large force 152. Once the biasing element 150 is extended and the arms 110 locked in the first position 126 with the release mechanism 160, the engineer can remove the fluid through the same port 146 or another port, thereby allowing the biasing element 150 to retract as described both above and below once the release mechanism 160 is actuated. Of course, one of skill in the art will understand that, depending on the type and orientation of the biasing element 150, the port or ports 146 may be positioned above, below, and on either side of the lower traveling head 142.

As noted, the tool 100 includes a release mechanism 160. Optionally, the release mechanism 160 is an electro-mechanically operated or actuated device that is fixed relative to the inner surface 116. A housing 162 optionally covers a portion or all of the release mechanism 160.

The release mechanism 160 is coupled to the centering mechanism 120, and more specifically, to the upper traveling head 130 via the union 134 and the rods 136 and 138 as previously discussed.

The release mechanism 160 includes a locked position 164 in which the release mechanism 160 maintains the upper traveling head 130 and/or the arms 110 in their first position 126. In some embodiments, the release mechanism 160 grasps or clamps the second rod 138 to maintain the upper traveling head 130 and/or the arms 110 in their first position 126. Stated differently, in the locked position 164, the release mechanism 160 applies a second force 168 to the centering mechanism 120 that opposes the first force 152 that the biasing mechanism applies the centering mechanism 120. In so doing, the release mechanism maintains the upper traveling head 130 and/or the arms 110 in their first position 126 (or second position 128 in the embodiment in which those positions are reversed).

Upon receiving an actuation signal 207 (FIG. 8), the release mechanism 160 transitions from a locked position 164 to a released position 166. In a released position 166, however, the release mechanism 160 releases the upper traveling head 130 and/or the arms 110, thereby allowing the biasing mechanism 140 and, specifically, the biasing element 150, to urge the upper traveling head 130 and/or the arms towards their second position 128. In some embodiments, the release mechanism 160 releases its grasp on the second rod 138 when it transitions to its release position 166. Stated differently, in the released position 166 the release mechanism 160 no longer applies the second force 168, thereby allowing the biasing mechanism 140 to urge the upper traveling head 130 and/or the arms 110 from their first position 126 to their second position 128 (or vice-versa).

Figure 6:
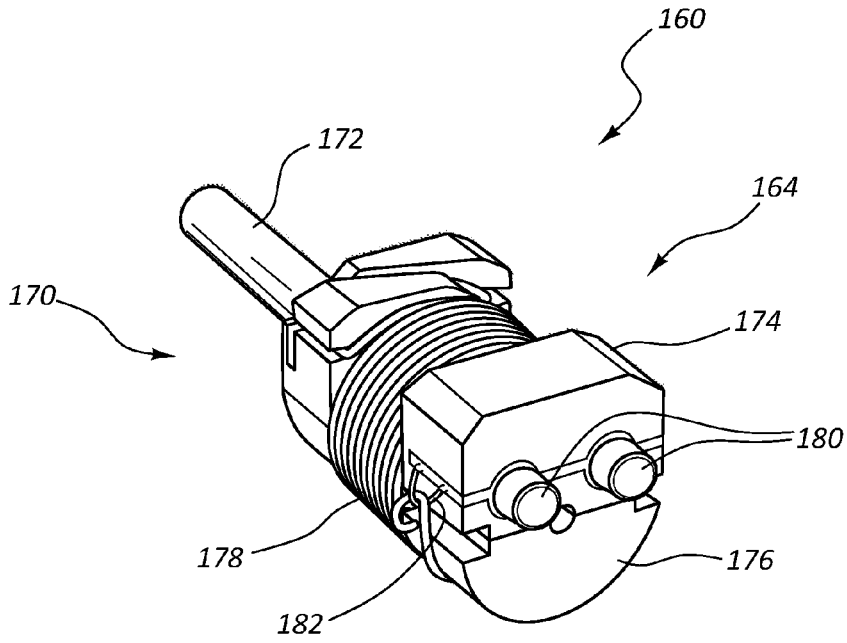
FIG. 6 is a perspective view of an embodiment of a release mechanism in the locked position.
Figure 7:
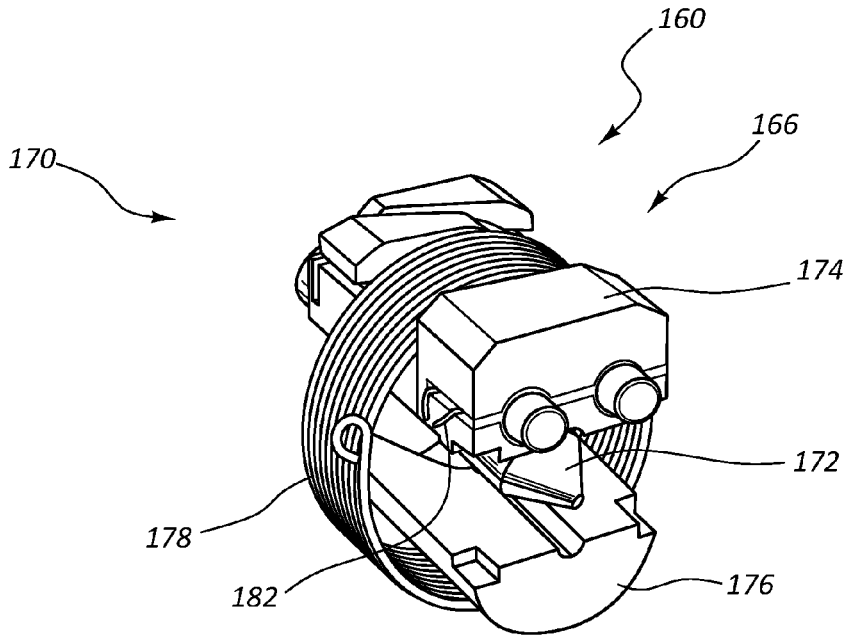
FIG. 7 is a perspective view of an embodiment of the release mechanism of FIG. 6 in the released position.

An embodiment of an electro-mechanically actuated or operated release mechanism 160 is a split-spool 170, examples of which are illustrated in FIGS. 6 and 7 without the housing 162. Such split-spool release mechanisms 160 are available from Cooper Interconnect of Camarillo, Calif.

The split-spool 170 in FIG. 6 is illustrated in the locked position 164. A spring-loaded plunger 172 is locked in a compressed or armed position between the upper spool 174 and the lower spool 176. A wire 178 is tightly wound or wrapped around the upper spool 174 and the lower spool 176 to hold the two halves of the split-spool 170 together and thereby provide the necessary compressive force to hold the spring-loaded plunger in the locked position 164. In this position, the split-spool 170 would grasp the second rod 138 that couples the release mechanism 160 to the centering mechanism 120.

To transition the split-spool 170 from its locked position 164 to its released position 166, an actuation signal 207, typically an electric current, is applied to one or both of the electrical contacts 180. The electrical contacts 180 are connected to a link wire 182 that opens when it receives the actuation signal 207. When the link wire 182 opens it release the tension on the wire 178, which then expands radially and releases the tension the wire 178 previously held on the upper spool 174 and the lower spool 176.

Once the tension on the split-spool 170 is released, the spring-loaded plunger 172 facilitates the separation of the upper spool 174 from the lower spool 176 by moving forward, i.e., towards the upper spool 174 and the lower spool 176. In the released position 166, the split-spool 170 would release the second rod 138, which would be urged towards the biasing mechanism 140 under the influence of the biasing element 150 and as aided by the forward movement of the spring-loaded plunger 172.

Figure 8:
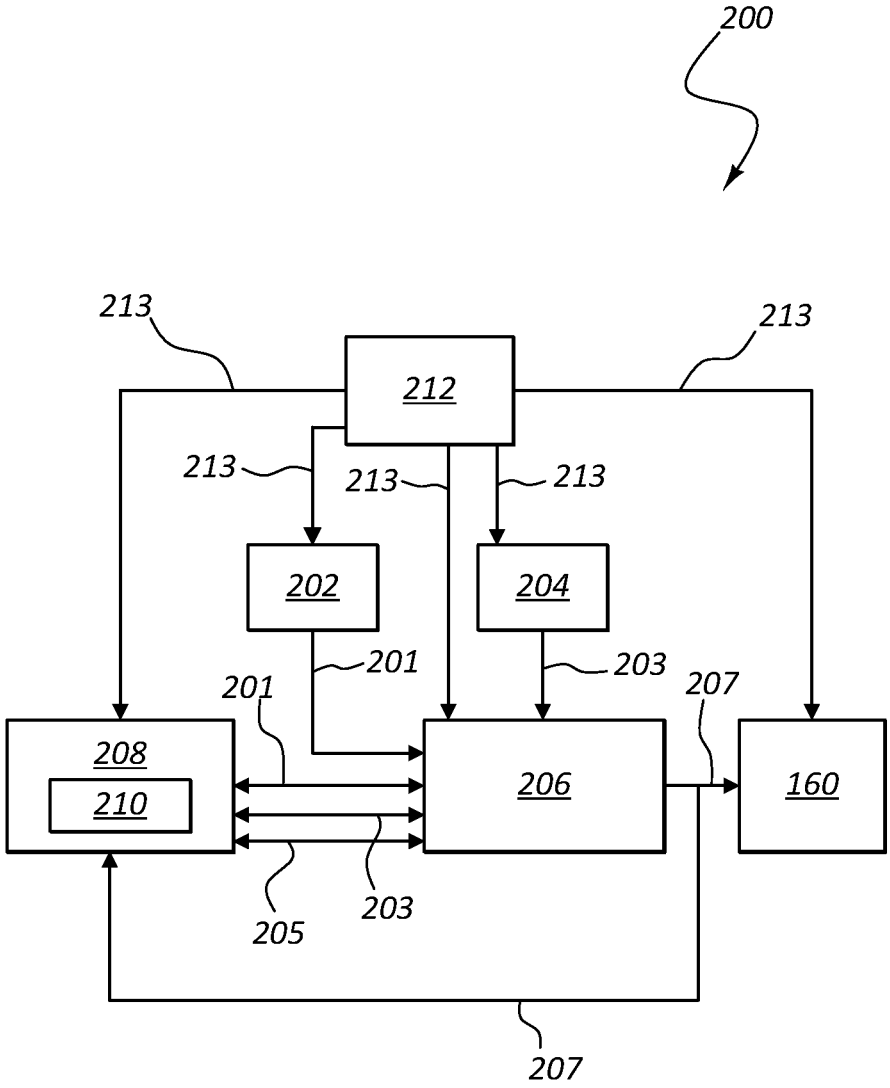
FIG. 8 is an embodiment of a control system for the tool in FIG. 1.

Also disclosed are embodiments of a control system 200 as described below and as illustrated in FIG. 8. The control system 200 is suitable for controlling the tool 100 and, more particularly, the actuation of the release mechanism 160 and the centering mechanism 120.

The control system 200 includes a first sensor 202 positioned on the tool 100. The first sensor 200 is configured to detect a first parameter and generate a first signal 201 reflective of the first parameter. The control system 200 also optionally includes at least a second sensor 204. As with the first sensor 202, the second sensor 204 is configured to detect at least a second parameter and generate a second signal 203 reflective of the second parameter. In some embodiments, at least one of the first sensor 202 and the second sensor 204 are positioned on the tool 100 and, more particularly, one or both of the sensors 202, 204 are positioned on a controller 206. Of course, the sensors 202, 204 can each be positioned on another tool that is electrically coupled to the tool 100 as discussed above, and/or electrically coupled to the tool 206 via the surface system 30 and the communication link 102.

The first sensor 202 and the second sensor 204 optionally are selected from various known sensors. In one embodiment, the first sensor 202 and the second sensor 204 is selected from the group consisting of a resistivity sensor, a power sensor, a vibration sensor, an accelerometer, a pressure sensor, an acoustic sensor, an electromagnetic sensor, a gamma ray sensor, a neutron sensor, magnetometers—including those for use as a collar locater, temperature sensor, flow sensors (sometimes referred to as spinners), and other known types of sensors.

For example, the first sensor 202 may include a resistivity/continuity sensor that is configured to detect whether there is communication and/or power being transmitted or received over the communication link 102. In the event of a break or a short in the communication link 102, the first sensor 202 would detect the change in continuity and/or resistivity of the communication link 102.

The second sensor 204 optionally provides additional data to confirm whether or not the tool 100 is moving, particularly when compared with the data that the first sensor 202 provides. For example, an accelerometer would provide an indication that the tool is moving. If the first sensor 202 is a resistivity/continuity sensor that detected a change in the continuity of the communication link 102, which suggests the possibility that the communication link 102 is broken, the control system 200 is able to query the accelerometer data from sensor 204. If the accelerometer data suggests that the tool 100 is still moving, the control system 200 can infer then that the cause of the loss of continuity as detected by sensor 202 is for a reason other than a break in the communication link 102 (e.g., a failure in a component of the surface system 30 or another electronic component in the tool 100). One of skill in the art will appreciate that the data for the different types of sensors disclosed, their equivalents, and others known in the art, can often be used to confirm the data from the first sensor 202 and the status (e.g., stuck/free, connected/disconnected, controlled movement/free fall) of the tool 100.

The control system 200 also includes a memory storage device 208 configured to store an operating program 210 and, optionally, the first signal 201 and the second signal 203, typically along with a time-stamp. As one will appreciate, the ability to store the first signal 201 and/or the second signal 203 in the memory storage device 208 permits logging of the data at least as a function of time and, given the proper equipment, depth. Thus, the tool 100 enables logging-while-fishing operations in addition to more traditional logging operations. Any such data recorded can be transmitted in whole or in part to the surface via the communication link 102 and/or optionally downloaded to the surface system 30 when the tool 100 is returned to the surface, regardless of whether the tool 100 is fished from the wellbore 20 or returns in the same manner in which the tool 100 was conveyed into the wellbore 20.

The memory storage device 208 includes various types of recordable media, including random access memory, read only memory, removable media, as well as a hard-wired specific instruction chip, and other known types. In addition, the memory storage device 208 may be a separate element or it may be incorporated into a computer system or controller 206, as described below.

The operating program 210 is configured to calculate an actuation signal 207. The actuation signal 207 is a function of at least one of the first signal 201 and the second signal 203. In some embodiments, the actuation signal 207 is calculated as a function of a difference in at least one of the first signal 201 and/or the second signal 203 received by the controller 206 and/or retrieved by the controller 206 from the memory storage device 208 at a first time and at a subsequent time. The memory storage device 208 optionally stores the actuation signal 207.

As an example of an embodiment of the operating program 210, it may use the first signal 201 generated by the first sensor 202 that, for purposes of this example, is a resistivity/continuity sensor configured to detect whether there is communication and/or power being transmitted or received over the communication link 102. (Of course, the operating program 210 may use the second signal 203 in addition or in the alternative to the first signal 201). In the event of a break or a short in the communication link 102, the first sensor 202 would detect the change in continuity and/or resistivity of the communication link 102. The first signal 201, then, would be reflective of continuity/expected resistivity at a first time, and a lack of continuity/change in resistivity at a second time.

In this instance, the operating program 210 may determine that the tool 100 may have become decoupled from the communication link 102. At this point, the operating program 210 may calculate or determine that an actuation signal 207 is warranted to actuate the centering mechanism 120. Alternatively, the operating program 210 may wait an additional period of time to determine what changes, if any, further occur in the first signal 201 at subsequent times relative to the first time and/or it may use other data, such as the second signal 204 and/or other additional signals, to determine whether or not it should calculate and transmit (via the controller 206) the actuation signal 207.

In the event the first signal 201 is not dispositive, the operating program 210 may use the second signal 203 generated by the second sensor 204 to provide additional data. For purposes of this example, assume the second sensor is a gamma sensor or gamma ray sensor configured to detect and quantify the presence of gamma rays in the wellbore 20. If the tool 100 were stuck, i.e., not moving, or had decoupled from the communication link 102, i.e., not moving, there typically would be little to no change in the second signal 203 when measured at a first time and at subsequent times. This result, then, would further suggest that the tool 100 is stuck or decoupled, and the operating program would calculate or determine that the actuation signal 207 should be generated and sent via the controller 206 to the release mechanism 160.

As an alternative example, the second sensor 204 may be a magnetometer for use as a collar locator. The second signal 203 indicates rapidly occurring magnetic spikes over a short interval of time. Such a pattern of second signals 203 suggests that the magnetometer/second sensor 204 is rapidly passing by the tool joints and/or collars of drill pipe and/or casing. This data suggests, then that the tool 100 is in free fall and, when combined with the resistivity/continuity data from the first sensor 202, may be considered dispositive of the tool having decoupled and is now falling towards the bottom of the wellbore 20. Other similar such calculations can be made for any number of different types of sensors and related signals.

In some embodiments, the operating program 210 and/or the controller 206 may include a provision to allow a user at the surface system 30 to override the program and to instruct the operating program 210 to generate and transmit the actuation signal 207 via the controller 206 to the release mechanism 160 regardless of the data that the first sensor 202 and/or the second sensor 204 are detecting.

The control system 200 also includes the controller 206, such as a general purpose computer, specific purpose computer, reduced instruction set chips, and other known types of controllers and/or processors. The controller 206 receives at least one of the first signal 201 and the second signal 203 either directly from the first sensor 202 and the second sensor 204, respectively, or retrieves the first signal 201 and the second signal 203 from the memory storage device 208 which had previously received it directly from the first sensor 202 and the second sensor 204 or the controller 206. The controller 206 additionally calls or runs 205 the operating program 210 in order to calculate the actuation signal 207. The controller 206 then transmits the calculated actuation signal 207 to the release mechanism 160 to transition the release mechanism 160 from its locked position 164 to its unlocked position 166. In some embodiments, leads or electrical conduits 216 electrically couple the controller 206 to at least one of the first sensor 202, the second sensor 204, the memory storage device 208, the power source 212, and the release mechanism 160.

The control system 200 includes at least one power source 212 that provides power 213 at least one of the first sensor 202, the second sensor 204, the memory storage device 208 and the controller 206 through, for example, leads or electrical conduits 214. For example, the power source 202 typically is a chemical source of power, such as a battery (rechargeable or otherwise) on the tool 100, although the power source may be located elsewhere. For example, the power source 212 may be a source of electrical power provided by the surface system 30, which transmits the power via the communication link 102 to the tool 100. In other embodiments, the power source 212 may be located on another tool to which the tool 100 is coupled. For examples, the power source 212 may be batteries and/or a generator coupled to a turbine that converts the flow of a drilling fluid into electrical power.

Another embodiment of a control system 200 is configured to calculate an actuation signal 207 for use in actuating a component of a tool 100 positioned in a wellbore 20. A first sensor 202 is positioned on the tool 100 and detects a first parameter and generates a first signal 201 reflective of the first parameter. At least a second sensor 204 detects at least a second parameter and generates a second signal 203 reflective of the second parameter. A memory storage device 208 stores an operating program 210, which calculates the actuation signal 207 as a function of at least one of the first signal 201 and the second signal 203. A controller 206 is configured to receive at least one of the first signal 201 from the first sensor 202 and the second signal 203 from the second sensor 204, to run the operating program 210, and to transmit the actuation signal 207 to the component. At least one power source 212 provides power to at least one of the first sensor 202, the second sensor 204, the memory storage device 208, and the controller 206. Optionally, the component that the control system 200 actuates with the actuation signal 207 is a release mechanism 160 that controls a centering mechanism 120 configured to move a housing centerline 106 of the tool 100 towards a centerline 24 of the wellbore 20 in which the tool 100 is positioned.

Also disclosed are embodiments of an operating program 210 to calculate an actuation signal 207 as a function of at least one of a first signal 201 reflective of a first parameter as detected and generated by a first sensor 202 and a second signal 203 reflective of a second parameter as detected and generated by a second sensor 204. The actuation signal 207 is used to actuate a component of a tool 100 positioned in a wellbore 20. The operating program 210 includes, in part, a memory storage device 208 to store the operating program 210 and to store at least one of the first signal 201 and the second signal 203 at a first time and at a subsequent time. A controller 206 is configured to receive at least one of the first signal 201 from the first sensor 202 and the second signal 203 from the second sensor 204, to run the operating program 210, and to transmit the actuation signal 207 to the component of the tool 100. At least one power source 212 that provides power to at least one of the memory storage device 208 and the controller 206. In some embodiments, the operating program 210 calculates the actuation signal 207 as a function of a difference in at least one of the first signal 201 and the second signal 203 at the first time and at the subsequent time. In some embodiments, the actuation signal 207 actuates a component that is a release mechanism 160 that controls a centering mechanism 120 configured to move a housing centerline 106 of a tool 100 towards a centerline 24 of the wellbore 20 in which the tool 100 is positioned.

In addition, methods of calculating the actuation signal 207 are disclosed. One embodiment of such a method is for calculating an actuation signal 207 for use in actuating a component of a tool 100 positioned in a wellbore 20. Optionally, the tool 100 includes a first sensor 202 and at least a second sensor 204, and a memory storage device 208 that stores an operating program 210 that calculates the actuation signal 207. A controller 206 is configured to receive at least one of a first signal 201 generated by the first sensor 202 and a second signal 203 generated by the second sensor 204, to run the operating program 210, and to transmit the actuation signal 207 to the component. At least one power source 212 provides power to at least one of the first sensor 202, the second sensor 204, the memory storage device 208, and the controller 206.

The method itself comprises detecting at least one of a first parameter with the first sensor 202 and a second parameter with the at least second sensor 204. The method further includes generating at least one of the first signal 201 representative of the first parameter with the first sensor 202 and the second signal 203 representative of the second parameter with the at least second sensor 204. At least one of the first signal 201 and the second signal 203 at a first time and at a subsequent time are stored on the memory storage device 208. An actuation signal 207 is calculated as a function of a difference in at least one of the first signal 201 and the second signal 203 at the first time and at the subsequent time. The method also includes transmitting the actuation signal 207 to the component. In some embodiments, the component to be actuated by the actuation signal 207 is a release mechanism 160 that controls a centering mechanism 120 configured to move a housing centerline 106 of the tool 100 towards a centerline 24 of the wellbore 20 in which the tool 100 is positioned.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A control system for a centering mechanism configured to move a housing centerline of a tool towards a centerline of a wellbore in which the tool is positioned, said tool including a housing, an outer surface, and an inner surface spaced apart from said outer surface, said wellbore including a wellbore wall and a wellbore diameter centered upon and extending radially away from said centerline, said control system comprising:

a centering mechanism that includes:

an upper traveling head having a first position and a second position;

at least one arm having a first end and a second end spaced apart from said first end, said first end being pivotally connected to said upper traveling head, such that when said upper traveling head is in said first position said first end and said second end are proximate said housing centerline and when said upper traveling head is in said second position said first end is proximate said housing centerline and said second end is positioned radially away from said housing centerline;

a biasing mechanism including:

a first end coupled to said upper traveling head;

a second end spaced apart from said first end, said second end being fixed relative to said inner surface;

a biasing element coupled to said first end and said second end of said biasing mechanism; and, a release mechanism coupled to said upper traveling head, said release mechanism being electro-mechanically actuated from a locked position in which said release mechanism maintains said upper traveling head in said first position to a released position in which said release mechanism releases said upper traveling head, thereby allowing said biasing element to urge said upper traveling head towards said second position;

a first sensor positioned on said tool, said first sensor detecting a first parameter and generating a first signal reflective of said first parameter;

at least a second sensor, said second sensor detecting at least a second parameter and generating a second signal reflective of said second parameter;

a memory storage device to store an operating program, said operating program configured to calculate an actuation signal as a function of at least one of said first signal and said second signal;

a controller configured to receive at least one of said first signal from said first sensor and said second signal from said second sensor, to run said operating program, and to transmit said actuation signal to said release mechanism to transition said release mechanism from a locked position to a released position; and, at least one power source that provides power to at least one of said first sensor, said second sensor, said memory storage device, and said controller.

2. The control system of claim 1, wherein at least one of said first sensor and said at least second sensor is positioned on said controller.

3. The control system of claim 1, wherein at least one of said first sensor and said at least second sensor is selected from the group consisting of a continuity sensor, resistivity sensor, a power sensor, a vibration sensor, an accelerometer, a pressure sensor, an acoustic sensor, an electromagnetic sensor, a gamma ray sensor, a neutron sensor, a magnetometer, a temperature sensor, and a flow sensor.

4. The control system of claim 1, wherein said memory storage device stores at least one of said first signal and said second signal at a first time and at a subsequent time and said operating program calculates said actuation signal as a function of a difference in at least one of said first signal and said second signal at a first time and at a subsequent time.

5. The control system of claim 1, wherein said control system further comprises a communication link able to at least one of transmit data to and receive data from a surface system.

6. The control system of claim 1, wherein said release mechanism further comprises a split-spool.

7. The control system of claim 1, wherein said tool comprises a wireline conveyed tool.

8. The control system of claim 1, wherein said biasing mechanism further comprises at least one of a spring and a linear actuator.

9. The control system of claim 1, wherein said housing further comprises at least one opening that extends from said inner surface to said outer surface and wherein said at least one arm at least partly is positioned within said opening.

10. The control system of claim 1, wherein said at least one arm presses against said wellbore wall and urges said housing centerline towards said wellbore centerline when said second end of said at least one arm is positioned radially away from said housing centerline.

11. A control system configured to calculate an actuation signal for use in actuating a component of a tool positioned in a wellbore, said tool being initially connected via a communication link to a surface system, said control system comprising:

a first sensor positioned on said tool, said first sensor detecting a first parameter and generating a first signal reflective of said first parameter;

at least a second sensor, said second sensor detecting at least a second parameter and generating a second signal reflective of said second parameter;

a memory storage device to store an operating program, said operating program configured to calculate said actuation signal as a function of at least one of said first signal and said second signal when said tool becomes decoupled from said communication link;

a controller configured to receive at least one of said first signal from said first sensor and said second signal from said second sensor, to run said operating program, and to transmit said actuation signal to said component; and, at least one power source that provides power to at least one of said first sensor, said second sensor, said memory storage device, and said controller.

12. The control system of claim 11, wherein at least one of said first sensor and said at least second sensor is positioned on said controller.

13. The control system of claim 11, wherein at least one of said first sensor and said at least second sensor is selected from the group consisting of a continuity sensor, resistivity sensor, a power sensor, a vibration sensor, an accelerometer, a pressure sensor, an acoustic sensor, an electromagnetic sensor, a gamma ray sensor, a neutron sensor, a magnetometer, a temperature sensor, and a flow sensor.

14. The control system of claim 11, wherein said memory storage device stores at least one of said first signal and said second signal at a first time and at a subsequent time and said operating program calculates said actuation signal as a function of a difference in at least one of said first signal and said second signal at a first time and at a subsequent time.

15. The control system of claim 11, wherein said control system further comprises a communication link able to at least one of transmit data to and receive data from a surface system.

16. The control system of claim 11, wherein said component actuated by said actuation signal is a release mechanism that controls a centering mechanism configured to move a housing centerline of said tool towards a centerline of said wellbore in which said tool is positioned.

17. An operating program to calculate an actuation signal as a function of at least one of a first signal reflective of a first parameter as detected and generated by a first sensor and a second signal reflective of a second parameter as detected and generated by a second sensor, said actuation signal being used to actuate a component of a tool positioned in a wellbore, said tool being initially connected via a communication link to a surface system, said operating program comprising:

a memory storage device to store said operating program and to store at least one of said first signal and said second signal at a first time and at a subsequent time;

a controller configured to receive at least one of said first signal from said first sensor and said second signal from said second sensor, to run said operating program, and to transmit said actuation signal to said component once said tool is decoupled from said communication link; and, at least one power source that provides power to at least one of said memory storage device and said controller.

18. The operating program of claim 17, wherein said operating program calculates said actuation signal as a function of a difference in at least one of said first signal and said second signal at said first time and at said subsequent time.

19. The operating program of claim 17, wherein at least one of said first sensor and said at least second sensor is selected from the group consisting of a continuity sensor, resistivity sensor, a power sensor, a vibration sensor, an accelerometer, a pressure sensor, an acoustic sensor, an electromagnetic sensor, a gamma ray sensor, a neutron sensor, a magnetometer, a temperature sensor, and a flow sensor.

20. The operating program of claim 17, wherein said component actuated by said actuation signal is a release mechanism that controls a centering mechanism configured to move a housing centerline of a tool towards a centerline of said wellbore in which the tool is positioned.

21. A method of calculating an actuation signal for use in actuating a component of a tool positioned in a wellbore, said tool being initially connected via a communication link to a surface system, said tool including a first sensor and at least a second sensor, a memory storage device that stores an operating program that calculates said actuation signal, and a controller configured to receive at least one of a first signal generated by said first sensor and a second signal generated by said second sensor, to run said operating program, and to transmit said actuation signal to said component, and at least one power source that provides power to at least one of said first sensor, said second sensor, said memory storage device, and said controller, said method comprising:

detecting at least one of a first parameter with said first sensor and a second parameter with said at least second sensor;

generating at least one of said first signal representative of said first parameter with said first sensor and said second signal representative of said second parameter with said at least second sensor;

storing at least one of said first signal and said second signal at a first time and at a subsequent time on said memory storage device;

calculating said actuation signal as a function of a difference in at least one of said first signal and said second signal at said first time and at said subsequent time;

transmitting said actuation signal to said component when said tool becomes decoupled from said communication link; and, actuating said component.

22. The method of claim 21, wherein at least one of said first sensor and said at least second sensor is selected from the group consisting of a continuity sensor, resistivity sensor, a power sensor, a vibration sensor, an accelerometer, a pressure sensor, an acoustic sensor, an electromagnetic sensor, a gamma ray sensor, a neutron sensor, a magnetometer, a temperature sensor, and a flow sensor.

23. The method of claim 21, wherein said component actuated by said actuation signal is a release mechanism that controls a centering mechanism configured to move a housing centerline of a tool towards a centerline of said wellbore in which the tool is positioned.

24. The method of claim 23, wherein said centering mechanism includes at least one arm configured to be at least partly within an opening within an outer surface of said tool, said arm including a first position and a second position, and wherein said method further comprises urging said arm from said first position to said second position.

25. The method of claim 24, wherein said tool further comprises a biasing mechanism configured to urge said arm from said first position to said second position.

* * * * *